US005555706A

United States Patent [19]

Maoloni et al.

[11] Patent Number: 5,555,706

[45] Date of Patent: Sep. 17, 1996

[54] METHOD AND APPARATUS FOR STACKING PREFORMS FOR BLOW MOLDED PLASTIC CONTAINERS

[75] Inventors: Domenico Maoloni, Castorano; Adriano Pizi, Poggio di Bretta; Enrico Buonfigli, Ascoli Piceno; Alastair R. Tweedie, Ospitaletto, all of Italy

[73] Assignee: Hoover Universal, Inc., Plymouth, Mich.

[21] Appl. No.: 448,841

[22] Filed: May 24, 1995

[51] Int. Cl.[6] ..... B65B 35/50

[52] U.S. Cl. ..... 53/447; 53/544; 53/143

[58] Field of Search ..... 53/446, 447, 540, 53/544, 143; 414/788.3, 791.4, 793; 206/427, 446

[56] References Cited

U.S. PATENT DOCUMENTS

| | | | |
|---|---|---|---|
| 2,848,855 | 8/1958 | Ervine et al. | 53/143 |
| 3,313,394 | 4/1967 | Mills et al. | 53/446 |
| 3,453,802 | 7/1969 | Riddington | 53/544 |
| 3,878,665 | 4/1975 | Couten | 414/788.3 |
| 4,514,956 | 5/1985 | Varallo et al. | 53/544 |
| 4,905,456 | 3/1990 | Olaechea | 53/446 |
| 5,385,438 | 1/1995 | Fadaie | 53/446 |
| 5,439,110 | 8/1995 | Regan, II | 206/427 |

*Primary Examiner*—Lowell A. Larson
*Assistant Examiner*—Gene L. Kim
*Attorney, Agent, or Firm*—Harness, Dickey & Pierce, P.L.C.

[57] ABSTRACT

A method and apparatus for stacking preforms for blow molded containers wherein the preforms are generally tubular in shape having a closed end and a threaded end. The preforms are arranged so that they are in an array of predetermined size and shape. The preforms in the array are arranged in a plurality of side-by-side horizontally extending rows in which the preforms are upright and in a "threads up" orientation. Alternate rows of the preforms are picked up and inverted so that they are in a "threads down" orientation. The remaining rows are then picked up and positioned in an alternating relationship with the "threads down" rows of preforms, so that multiple layers of preforms can be stacked in a container so as to fully use all of the space in the container for storage and transfer of the preforms.

6 Claims, 4 Drawing Sheets

METHOD AND APPARATUS FOR STACKING PREFORMS FOR BLOW MOLDED PLASTIC CONTAINERS

BACKGROUND AND SUMMARY OF THE INVENTION

Bottles formed of polyethyleneterephthalate (PET) are made in two steps. First a preform is injection molded and then heated and blown into conformity with a mold cavity to form the desired bottle in a blow molding machine. The injection molding of the preforms and the blow molding of the bottles are not necessarily performed at the same location. As a result, the preforms are usually free dropped into a container and then transported to the blow molder site. In some cases, the containers are stored for long periods in warehouses.

The costs of handling and transporting the preforms often create unnecessary expenses. To reduce the impact of these expenses on a preform plant operation, the present invention provides a method whereby the containers for transporting the preforms are completely filled with preforms so that no space inside the container is wasted. The result is a much more efficient handling of the preforms with a consequent lowering of manufacturing costs.

Further objects, features and advantages of the invention will become apparent from a consideration of the following description and the appended claims when taken in connection with the accompanying drawings.

DESCRIPTION OF A PREFERRED EMBODIMENT OF THE INVENTION

Figure 1:
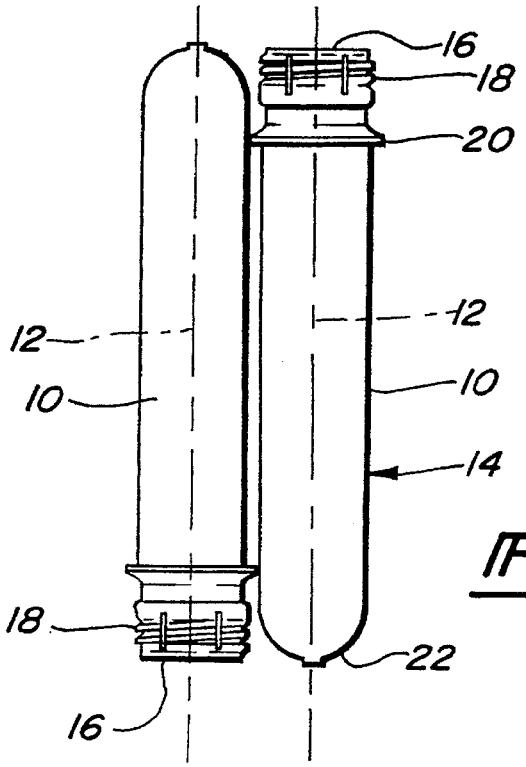
FIG. 1 is an elevation view of two preforms arranged side-by-side with one preform being in a "threads down" orientation and the other preform being in a "threads up" orientation.

With reference to the drawing, preforms of the type that the method and apparatus of this invention are concerned with are indicated at 10 in FIG. 1. Each of the preforms 10 consists of a hollow body 12 formed of PET. The body 12 is of tubular shape, having a longitudinally extending axis 14. The preform 10 has an open end 16 and is provided with a threaded finish 18 and a flange 20 which coact with the bottle cap (not shown) for sealing the bottle that is formed from the preform 10. The opposite end 22 of the preform 10 is the closed end and it is of semi-spherical shape. The preform 10 on the right in FIG. 1 is in what will hereinafter be referred to as the "threads up" position and the preform 10 on the left will be referred to as in the "threads down" position.

Figure 2:
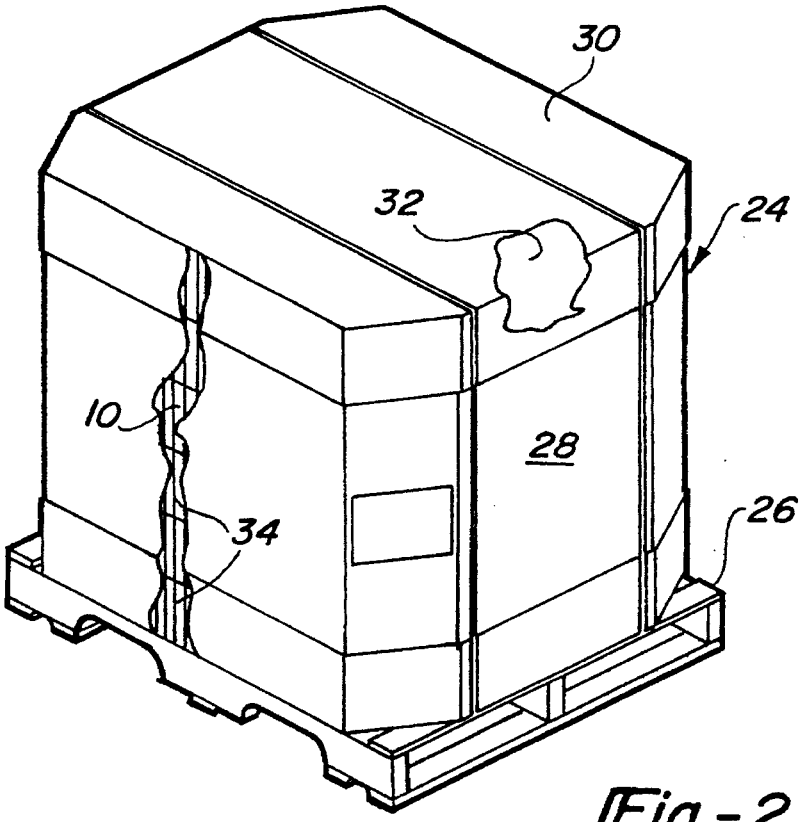
FIG. 2 is a perspective view of a container for transporting and storing the preforms shown in FIG. 1 in layers of rows.

In the method and apparatus of this invention, large numbers of the preforms 10 are stacked in a container such as the container 24 shown in FIG. 2 which is mounted on a pallet 26 to facilitate handling. The container 24 has upright side walls 28, illustrated as being eight in number, which are vertically disposed over their entire lengths from the pallet 26 to the top of the cover 30 which encloses the preforms 10 within the container 24. A plastic bag 32 is positioned within the container 24 so as to line the walls 28 and provide a plastic enclosure for the preforms for hygienic purposes.

Figure 3:
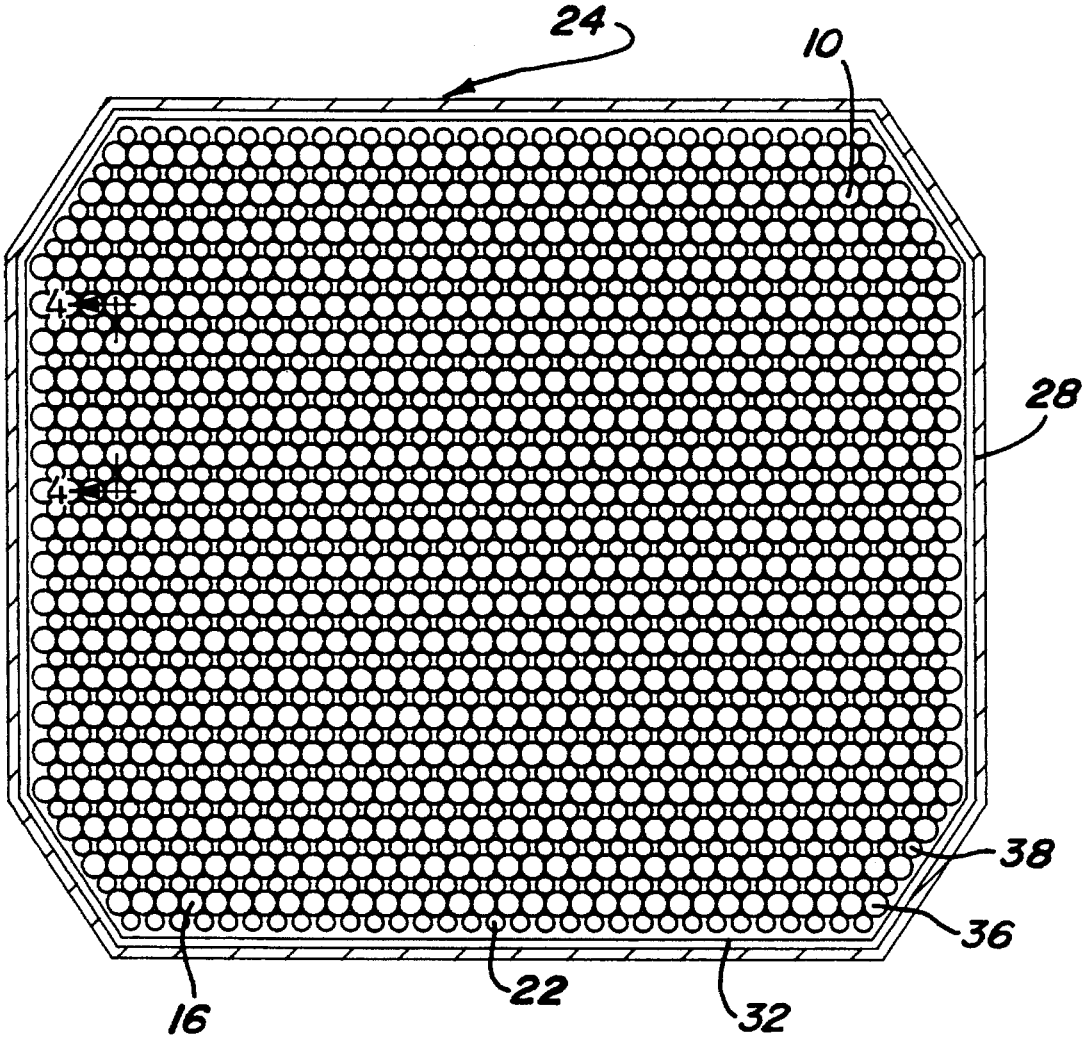
FIG. 3 is a plan view of a layer of preforms in the container shown in FIG. 2.

The preforms 10 are arranged in layers 34 in the container 24. Each layer 34 contains a large number of preforms 10 arranged in horizontally extending rows 36 and 38. In each of the rows 36, the preforms 10 are arranged side-by-side with each preform being in the "threads up" orientation shown in FIG. 1 with its axis 12 being vertical. As shown in FIG. 3, the rows 36 alternate with the rows 38. In each of the rows 38, the preforms 10 are in the "threads down" orientation.

Figure 4:
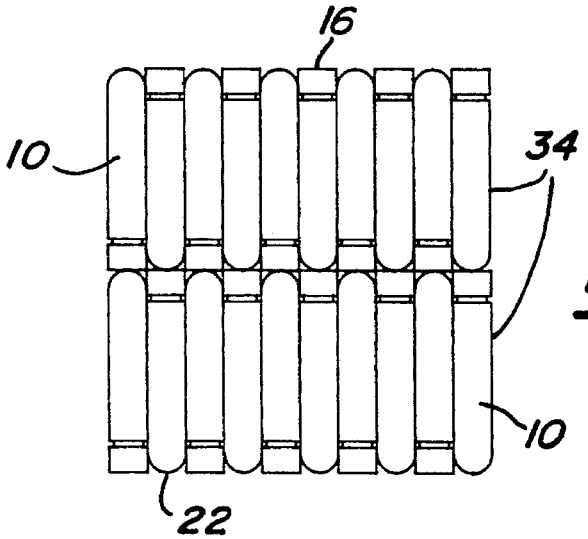
FIG. 4 is an enlarged view of portions of two layers of preforms in the stack shown in FIG. 3, as seen from substantially the line 4—4 in FIG. 3, illustrating the alternating orientations of the preforms in the rows in each layer.

As shown in FIG. 3, in each layer 34, the rows 36 and 38 go from wall to wall in the container 24 so that they completely occupy the space within the container 34 between the container walls 28 so that there are no spaces left for any additional preforms 10. As shown in FIG. 4, the layers 34 extend horizontally with one layer on top of the other. This results in vertically extending lines of preforms 10 in which the axes 12 of preforms 10 in adjacent layers are axially aligned and the rounded end 22 of one preform in the line extends into the open end 16 of the adjacent preform 10.

Figure 5:
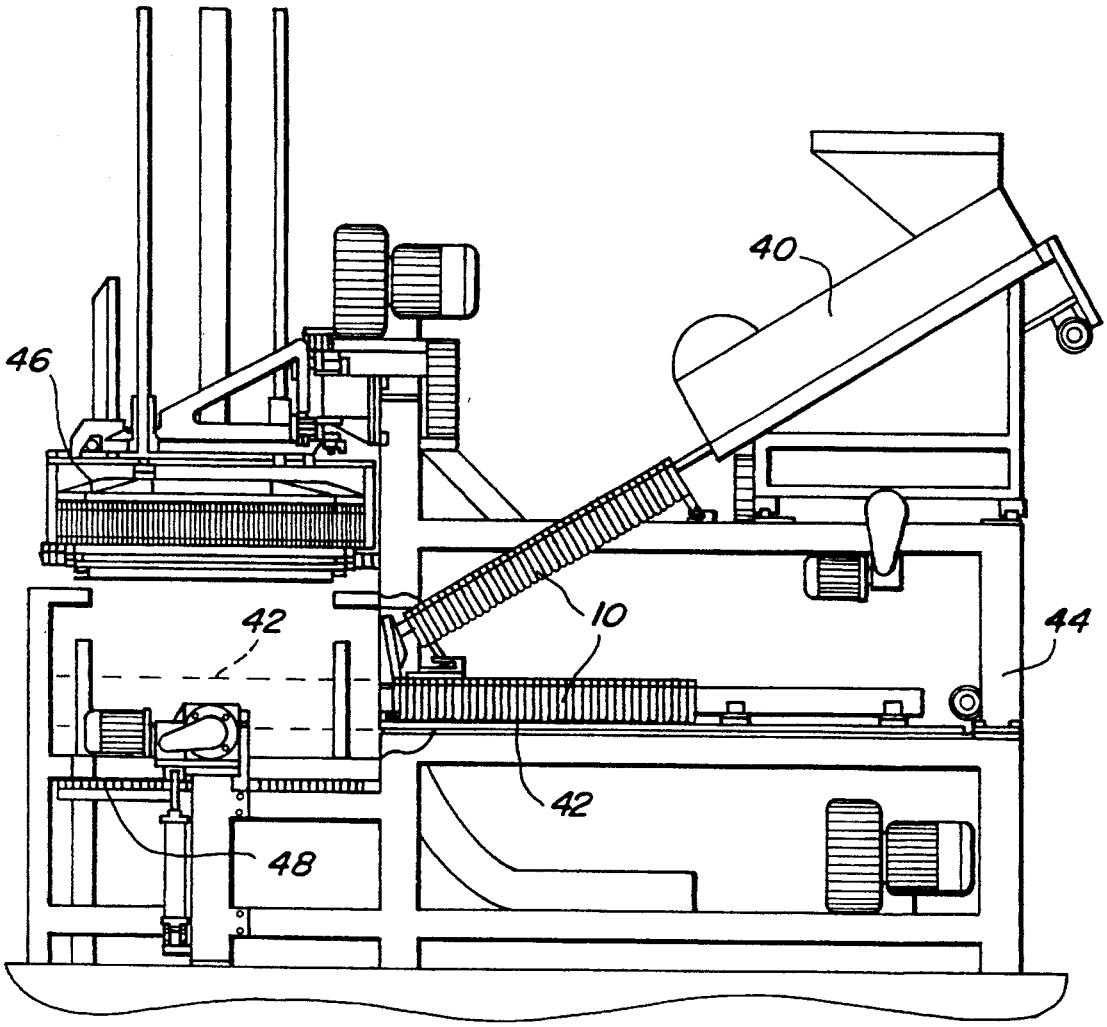
FIG. 5 is an elevational view of the stacking apparatus of this invention.
Figure 6:
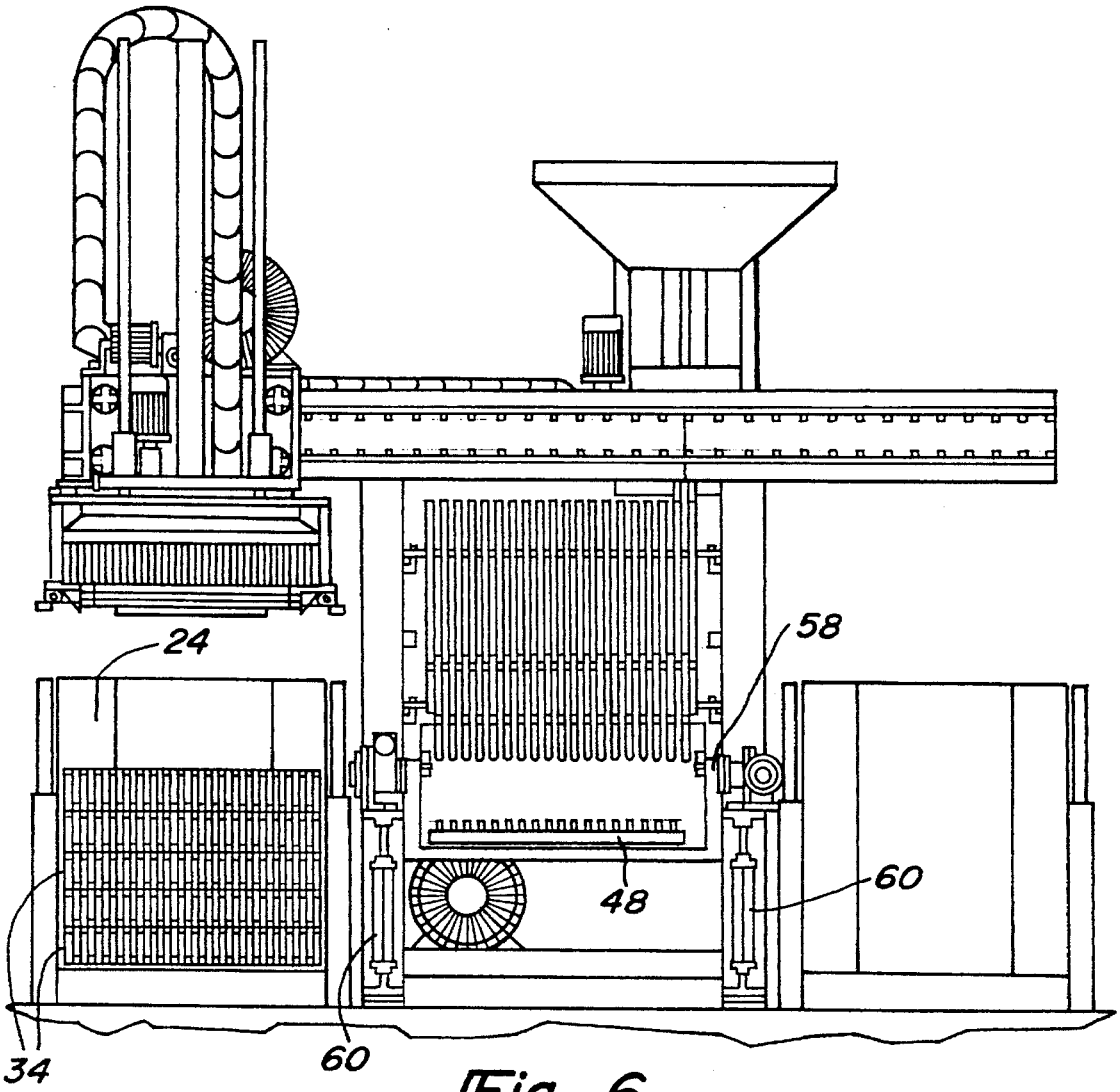
FIG. 6 is an end view of the apparatus shown in FIG. 5.
Figure 7:
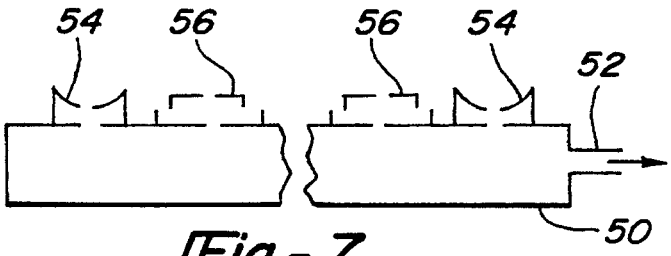
FIG. 7 is a diagrammatic view of a suction head used in the apparatus shown in FIGS. 5 and 6.

The apparatus for collecting the preforms 10, arranging them in first rows and then layers in the container 24 is shown in FIGS. 5–8, inclusive. Referring first to FIG. 5, the injection molded preforms are free dropped from the injection molding machine into a conventional linear orientator 40 which functions to put all of the preforms 10 in the "threads up" position when they leave the orientator 40.

From the orientator 40, the preforms are loaded onto an accumulator table 42 where the preforms 10 are arranged in side by side rows with all of the preforms in the "threads up" position.

The orientator 40 and the accumulator table 42 are mounted on a frame 44 which also supports an upper suction head 46 and a lower suction head 48. Each suction head 46 and 48 includes a body 50 which is connected through an inlet connection 52 to a vacuum pump. The body 50 is also equipped with suction cups 54 and suction fingers 56, the cups 54 being arranged in rows that alternate with rows of the fingers 56. The cups 54 are constructed so as to interfit with the rounded end 22 of the preforms 10 while the fingers 56 are shaped to telescope into the open ends 16 of a the preforms 10. The lower suction head 48 is mounted on a cradle 58 which is movable from its lower position shown in FIG. 6 to an upside down or inverted position above the level of the accumulator table 42. The table 42 is movable from its solid line position shown in FIG. 5 to a broken line position shown in FIG. 5 in which it is directly below the upside down suction head 48. The suction head 48 is then moved downwardly by actuation of the piston and cylinder assemblies 60 to positions in which the rows of suction fingers 56 telescope into the preforms 10 on the accumulator table 42. This enables the head 48 to remove every other row of preforms 10 on the accumulator table 42. The accumulator table 42 then indexes back to its solid line position shown in FIG. 5 and the cradle 58 is moved back to its position shown in FIG. 6 in which the rows of preforms on the suction head 48 are in a"threads down" position.

The accumulator table 42 is then indexed to the left as shown in FIG. 5 to its dotted line position in which the remaining rows of preforms on the accumulator table am aligned with rows of suction fingers 56 on the upper suction head 46. The upper suction head 46 is then lowered to a position in which fingers 56 thereon can lift the remaining preforms 10 from the accumulator table 42. The table 42 is then indexed to the right and the accumulator head is moved downwardly to a position in which the suction cups 54 engage the ends 22 of the preforms 10 on the lower suction head 48. The head 46 is then raised and moved to the position shown in FIG. 6 in which the it is vertically aligned with the container 24. The head 46 is then lowered into the container 24 so as to deposit another layer 34 of preforms 10 in the container 24.

The above sequence it then repeated to add additional layers 34 of preforms 10 in the container 24.

It can thus be seen that the method and apparatus of this invention provides for efficient stacking of preforms in the container 24 so that the preforms can be stored and/or transported for future use.

It is to be understood that the invention is not limited to the exact construction illustrated and described above, but that various changes and modifications may be made without departing from the spirit and scope of the invention as defined in the following claims.

We claim:

1. The method of filling a container having vertical side walls defining a storage space of uniform size in horizontal cross section, the container being filled with preforms for blow molded plastic containers, the preforms having a generally tubular shape with a closed end and a threaded end, said method comprising the steps of:

a) arranging the preforms in a first horizontal layer having a plurality of side-by-side rows of the preforms with all of the preforms having a common orientation, said layer corresponding in size and shape to said horizontal cross section of said container;

b) picking up a group of the preforms, the group being the alternate rows of the preforms c) picking up another group of the preforms, the group being the remaining rows of the preforms d) inverting one of the groups of picked up preforms so that they are in a threads down orientation e) repositioning the groups of preforms having been inverted with the group of preforms having not been inverted in a second horizontal layer of preforms so that the preforms are in a threads end up orientation in one of the rows and in a threads end down orientation in an adjacent row of preforms;

f) simultaneously moving the second horizontal layer of preforms into the bottom of the container, the rows forming a pattern corresponding to the cross sectional shape of the container; and g) repeating the above steps and moving consecutive layers of preforms into the container on top of the second horizontal layer in the bottom of the container.

2. The method of claim 1 wherein said preforms in vertically adjacent layers are arranged so that vertically adjacent rows are identically oriented to thereby provide for columns of said preforms in which all of said preforms are arranged in a threaded end to a closed end orientation.

3. The method of claim 1 further comprising the step of positioning a liner in said container, said layers being arranged within said liner.

4. The method of claim 3 further comprising the step of enclosing said preforms within said liner.

5. Apparatus for filling preforms for blow molded containers into a container having vertical side walls defining a storage space of uniform size in horizontal cross section, the preforms having a generally tubular shape with a closed end and a threaded end, said apparatus comprising:

a frame;

an accumulator table supported by said frame, said table including array means for supporting an array of preforms thereon and arranged in a plurality of side-by-side horizontally extending rows in which the preforms are upright and in a threads up orientation, said array corresponding in size and shape to the horizontal cross section of said container;

first carrying means for picking up alternate rows of said preforms from said array and inverting said alternate rows so that said preforms in said alternate rows are in a threads down orientation;

second carrying means for picking up remaining rows of said preforms from said array and positioning said remaining rows of preforms in a threads up orientation between said alternate rows of said preforms in said threads down orientation, said second carrying means also having means for simultaneously moving both said alternate rows and said remaining rows into the bottom of the container, said alternate and remaining rows forming a pattern corresponding to the cross sectional shape of the container.

6. Apparatus according to claim 5 wherein said carrying means includes suction heads having suction cups and suction fingers which respectively engage said preforms in said threads down orientation and said threads up orientation.

* * * * *